US007921671B2

(12) United States Patent
Yoshioka et al.

(10) Patent No.: US 7,921,671 B2
(45) Date of Patent: Apr. 12, 2011

(54) REFRIGERANT FLOW DIVIDER

(75) Inventors: Shun Yoshioka, Sakai (JP); Makio Takeuchi, Sakai (JP); Kazushige Kasai, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 739 days.

(21) Appl. No.: 11/919,559

(22) PCT Filed: Jun. 14, 2006

(86) PCT No.: PCT/JP2006/311916

§ 371 (c)(1), (2), (4) Date: Oct. 30, 2007

(87) PCT Pub. No.: WO2006/134961

PCT Pub. Date: Dec. 21, 2006

(65) Prior Publication Data

US 2009/0314022 A1 Dec. 24, 2009

(30) Foreign Application Priority Data

Jun. 14, 2005 (JP) ..... 2005-174030

(51) Int. Cl.
*F25B 39/02* (2006.01)

(52) U.S. Cl. ..... 62/525; 62/527

(58) Field of Classification Search ..... 62/259.1, 62/504, 511, 525, 527; 137/14, 561
See application file for complete search history.

(56) References Cited

U.S. PATENT DOCUMENTS

| | | | | |
|---|---|---|---|---|
| 3,864,938 | A * | 2/1975 | Hayes, Jr. | 62/504 |
| 4,277,953 | A * | 7/1981 | Kramer | 62/117 |
| 4,982,572 | A * | 1/1991 | Moore | 62/122 |
| 6,381,974 | B1 * | 5/2002 | Hwang et al. | 62/199 |
| 6,898,945 | B1 * | 5/2005 | Grove | 62/199 |
| 7,174,726 | B2 * | 2/2007 | Grau et al. | 62/115 |
| 2003/0056525 | A1 | 3/2003 | Taira | |
| 2004/0129006 | A1 | 7/2004 | Taira | |
| 2004/0172954 | A1 * | 9/2004 | Hanson et al. | 62/125 |
| 2005/0028553 | A1 * | 2/2005 | Grau et al. | 62/528 |

FOREIGN PATENT DOCUMENTS

| | | | |
|---|---|---|---|
| JP | 60-2775 | U | 1/1985 |
| JP | 7-55291 | A | 3/1995 |
| JP | 11-101530 | A | 4/1999 |
| JP | 2000-320929 | A | 11/2000 |
| JP | 2001-116396 | A | 4/2001 |
| JP | 2001-194028 | A | 7/2001 |
| JP | 2001-248941 | A | 9/2001 |
| JP | 2002-188869 | A | 7/2002 |

* cited by examiner

*Primary Examiner* — Mohammad M Ali

(74) *Attorney, Agent, or Firm* — Birch, Stewart, Kolasch & Birch, LLP

(57) ABSTRACT

A refrigerant flow divider is made up of an inlet pipe 12 through which refrigerant Xin flows in, a main body 11 of which the inside is a cavity, and a plurality of branching pipes 13 through which refrigerant Xout flows out. When the length of the above described main body 11 of the flow divider is L mm and the inner diameter of the above described main body 11 of the flow divider is $D_2$ mm, the relationship $2 \leqq L/D_2 \leqq 8$ holds, and thus, a flow divider can be gained, where discrepancy (variation) in the flow rate ratio in the respective paths for the flow discharged from the outlet of the flow divider and entering the heat exchanger is small and pressure loss is small when there is a change of approximately ±10° in the installation angle, a change in the dryness of the refrigerant at the inlet (0.2 to 0.4) or a change in the flow rate of the refrigerant (50% to 100%).

2 Claims, 4 Drawing Sheets

REFRIGERANT FLOW DIVIDER

TECHNICAL FIELD

The present invention relates to a refrigerant flow divider which is attached to a heat exchanger or the like for a refrigeration unit.

BACKGROUND ART

In the case where refrigerant is supplied to a heat exchanger with a plurality of heat transfer paths, such as an evaporator for a refrigeration unit, it is necessary to control the refrigerant supplied to the respective heat transfer paths with one expansion valve such that refrigerant coming out from the expansion valve is equally divided into the respective heat transfer paths by a refrigerant flow divider.

In the case of a refrigeration unit shown in FIG. 1, for example, refrigerant compressed by a compressor 1 is condensed in a condenser 2, and after that, sent to an expansion valve 3. The refrigerant of gas-liquid two-phase flow discharged from the expansion valve 3 is equally divided into the respective heat transfer paths of an evaporator 5 by a refrigerant flow divider 4 so as to be evaporated in the evaporator 5, and after that, is merged in a header 6 and recirculated to the compressor 1.

The refrigerant flow divider used in the above described refrigeration unit functions to equally divide the refrigerant, and the higher the degree of equality in the division is, the better.

Some conventional refrigerant flow dividers are made up of an inlet pipe, a main body of the refrigerant flow divider of which the inside is a cavity, and a plurality of branching pipes through which refrigerant flows out (see Patent Document 1). In other conventional refrigerant flow dividers, an orifice or a nozzle is provided inside the flow divider or an inlet pipe such that the flow rate of two-phase refrigerant increases, and thus, nonuniform flow is reduced (see Patent Document 2).

[Patent Document 1] Japanese Laid-Open Utility Model Publication No. 60-2775

[Patent Document 2] Japanese Laid-Open Patent Publication No. 2002-188869

DISCLOSURE OF THE INVENTION

Problem to Be Solved by the Invention

However, in the case of the refrigerant flow divider disclosed in Patent Document 1, when used for an evaporator, the flow rate ratio of the refrigerant divided into the respective paths set by capillaries (branching pipes) in advance, that is to say, the respective heat transfer paths, may change due to the angles set for the branching pipes relative to the main body of the flow divider, change in the flow rate of the refrigerant, dryness of the refrigerant and change in the temperature before the expansion valve, and thus, nonuniform flow may occur. This can greatly lowers the performance of the evaporator.

In addition, in the case of the refrigerant flow divider disclosed in Patent Document 2, the pressure loss increases in the flow divider, reducing the range of control by the refrigerant flow rate control valve.

The present invention is provided in view of the above described points, and an objective thereof is to provide a refrigerant flow divider which can equally divide refrigerant and has a small pressure loss.

Means for Solving Problem

In order to solve the above described problems, according to the present invention, in a refrigerant flow divider made up of an inlet pipe through which a refrigerant flows in, a main body of the flow divider of which the inside is a cavity, and a plurality of branching pipes through which the refrigerant flows out, when the length of the above described main body of the flow divider is L mm and the inner diameter of the above described main body 11 of the flow divider is $D_2$ mm, the ratio of the length L to the inner diameter $D_2$ is set to satisfy $2 \leqq L/D_2 \leqq 8$.

In the above described configuration, a flow divider can be obtained, where discrepancy (variation) in the flow rate ratio in the respective paths for the flow discharged from the outlet of the flow divider and entering the heat exchanger is small and pressure loss is small when there is a change of approximately ±10° in the installation angles of the branching pipes in the main body of the flow divider, a change in the dryness of the refrigerant at the inlet (0.2 to 0.4) or a change in the flow rate of the refrigerant (50% to 100%). In the case of $L/D_2<2$, unevenness in the distribution of the liquid refrigerant in the circumferential direction due to a discrepancy in the installation angles or a bend in the inlet pipe causes a discrepancy in the direction in which refrigerant coming in through the inlet pipe is ejected, and then a deviation in the distribution of the gas and liquid within the capillaries (in other words, within the branching pipes), and thus, nonuniform flow is caused in the refrigerant. Meanwhile, in the case of $L/D_2>8$, the liquid refrigerant flows while making contact with the inner wall surface of the main body of the flow divider, lowering the speed of the liquid refrigerant, and as a result, the refrigerant is subjected to the effects of gravity, so that the discrepancy in the installation angles makes the distribution of the gas and liquid in the circumferential direction uneven, and thus, nonuniform flow is caused in the refrigerant.

Furthermore, according to the present invention, it is desirable for the relationship $2 \leqq D_2^2/G \leqq 13$ to hold between the flow rate G and the inner diameter $D_2$ of the main body of the flow divider when the flow rate of the refrigerant flowing in through the above described inlet pipe is G kg/h.

In this case, the ascent velocity of the refrigerant becomes optimal within the main body of the flow divider, and thus, nonuniform flow is prevented without fail in the refrigerant. In the case of $D_2^2/G<2$, the ascent velocity of the refrigerant within the main body of the flow divider increases, and when unevenness in the distribution of the liquid refrigerant in the circumferential direction due to discrepancy in the installation angles or a bend in the inlet pipe causes a discrepancy in the direction in which the refrigerant coming in through the inlet pipe is ejected, a deviation is caused in the distribution of the gas and liquid within the capillaries (in other words, within the branching pipes), and thus, nonuniform flow is caused in the refrigerant.

Meanwhile, in the case of $D_2^2/G>13$, the ascent velocity of the refrigerant within the main body of the flow divider becomes low and the refrigerant is subjected to the effects of gravity, and the amount of stagnant liquid in the lower portion increases, in other words, the interface between the gas and the liquid rises. As a result, the discrepancy in the installation angles, or the discrepancy in the margin for insertion of capillaries (margin for insertion of branching pipes), makes the gas-liquid partition ratio refrigerant coming out through the branching pipes different between respective paths, and thus, nonuniform flow is caused in the refrigerant.

When the performance class of the refrigeration unit in which a heat exchanger provided with the above described refrigerant flow divider is mounted is C kW and the number of branches the refrigerant passes through within the refrigeration unit before flowing into the above described refrigerant flow divider is n, it is desirable for the inner diameter $D_2$ of the main body of the flow divider to satisfy $6.55(C/n)^{0.5} \leqq D_2 \leqq 9.64(C/n)^{0.5}$.

In this case, the ascent velocity of the refrigerant becomes optimal within the main body of the flow divider, and thus, nonuniform flow is prevented without fail in the refrigerant. In addition, the performance class of the refrigeration unit is a factor in setting the inner diameter $D_2$ of the main body of the flow divider. Therefore, the type of the refrigerant flow divider can be selected so as to correspond to the performance class of the refrigeration unit. Thus, selection of the refrigerant flow divider becomes easy.

In the case of $D_2<6.55(C/n)^{0.5}$, the ascent velocity of the refrigerant within the main body of the flow divider increases, and when unevenness in the distribution of the liquid refrigerant in the circumferential direction due to discrepancy in the installation angles or a bend in the inlet pipe causes a discrepancy in the direction in which the refrigerant coming in through the inlet pipe is ejected, a deviation is caused in the distribution of the gas and liquid within the capillary holes, in other words, within the branching pipes. Thus, nonuniform flow is caused in the refrigerant. Meanwhile, in the case of $D_2>9.64(C/n)^{0.5}$, the ascent velocity of the refrigerant within the main body of the flow divider becomes low and the refrigerant is subjected to the effects of gravity, and the amount of stagnant liquid in the lower portion increases. In other words, the interface between the gas and the liquid rises, and as a result, the discrepancy in the installation angles, or the discrepancy in the margin for insertion of capillaries (in other words, margin for insertion of branching pipes), makes the gas-liquid partition ratio of the refrigerant coming out through the branching pipes different between respective paths. Thus, nonuniform flow is caused in the refrigerant.

BEST MODE FOR CARRYING OUT THE INVENTION

In the following, the preferred embodiments of the present invention are described in reference to the accompanying drawings.

Figure 1:
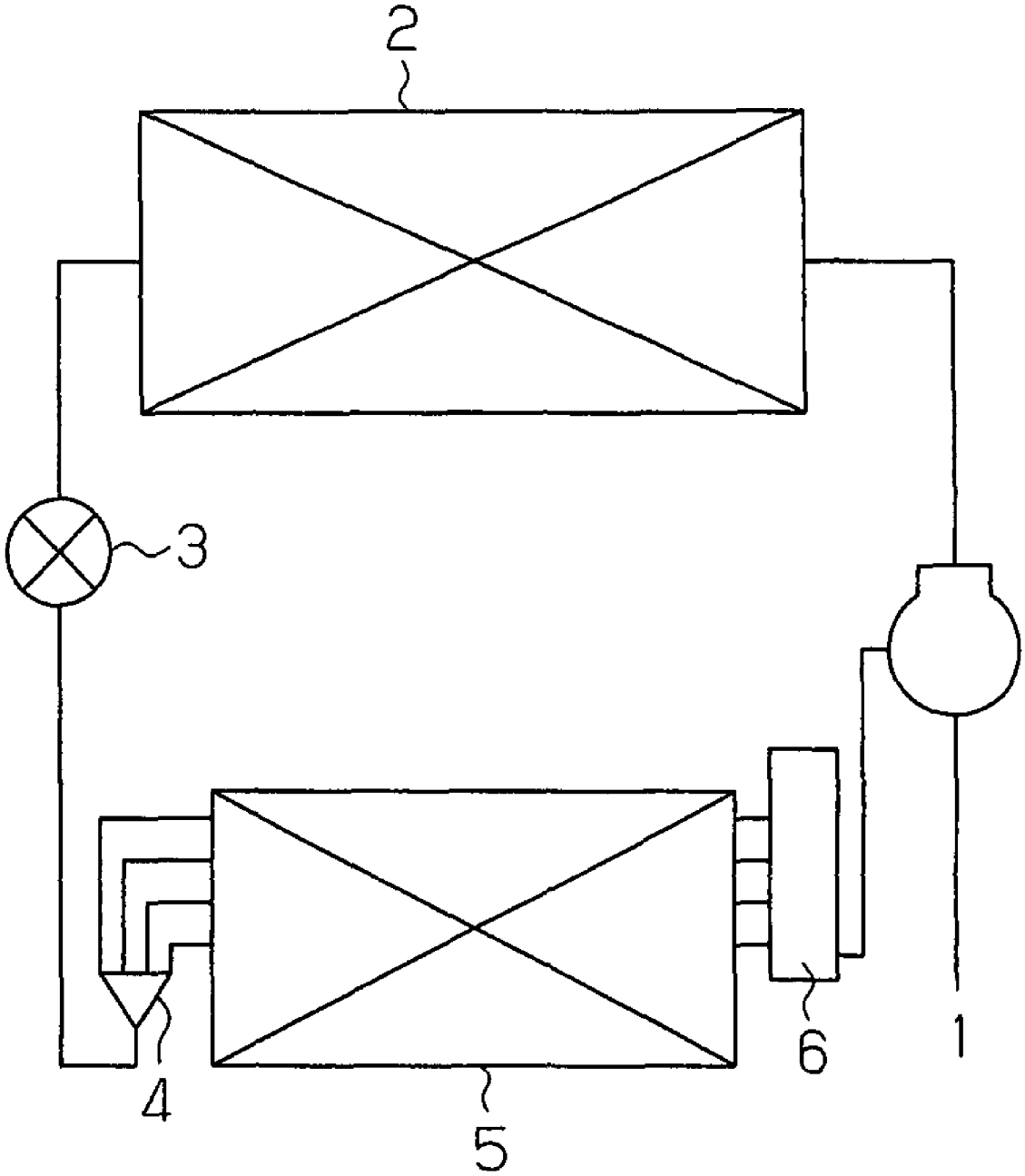
FIG. 1 is a diagram showing the cycle of refrigerant in a typical refrigeration unit.
Figure 2:
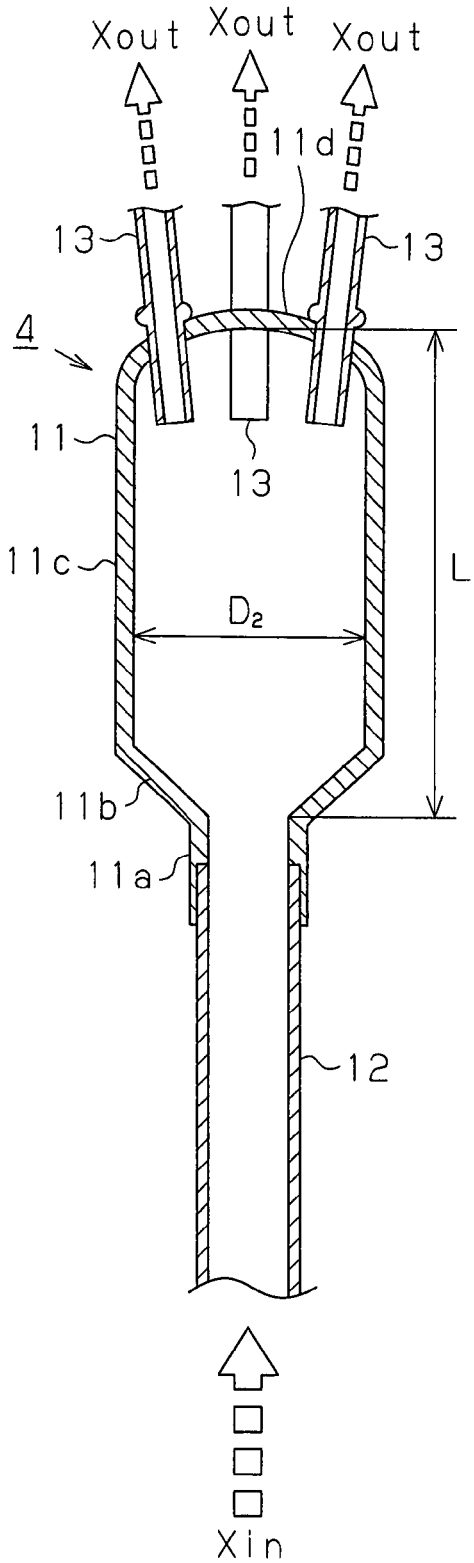
FIG. 2 is a longitudinal cross-sectional diagram showing a refrigerant flow divider according to an embodiment of the present invention.
Figure 3:
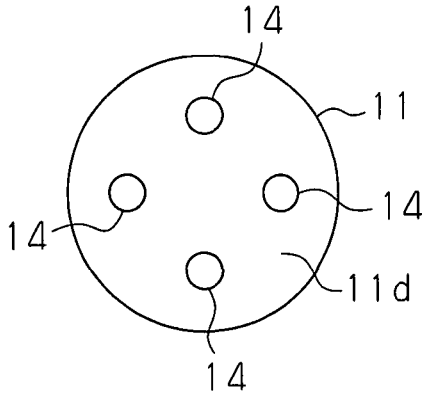
FIG. 3 is a plan view showing the refrigerant flow divider of FIG. 2 in a state where the branching pipes are removed.

The refrigerant flow divider according to the present invention is used in the refrigeration unit shown in FIG. 1, in the same manner as in the prior art, and composed of an inlet pipe 12 through which refrigerant Xin flows in, a main body 11 of the flow divider of which the inside is a cavity, and a plurality of branching pipes 13 (for example four pipes) through which refrigerant Xout flows out, as shown in FIGS. 2 and 3.

The above described main body 11 of the flow divider is provided with a connection portion 11*a* through which the above described inlet pipe 12 is connected, an increasing diameter portion 11*b* where the diameter gradually increases from this connection portion 11*a*, and a cylindrical portion 11*c* having the same diameter as the maximum diameter of this increasing diameter portion 11*b*. A branching pipe connecting portion 11*d* which protrudes toward the outside is provided in the top portion of the cylindrical portion 11*c*, and a plurality of holes 14 into which respective branching pipes 13 are inserted are provided in this connecting portion 11*d* at intervals of equal angles.

When the length of the above described main body 11 of the flow divider, that is to say, the distance between the border portion between the above described connection portion 11*a* and the increasing diameter portion 11*b* and the highest portion on the inner surface of the above described branch pipe connecting portion 11*d* is L mm, and the inner diameter of the above described main body 11 of the flow divider, that is to say, the inner diameter of the cylindrical portion 11*c*, is $D_2$ mm, the ratio of the length L to the inner diameter $D_2$ of the main body 11 of the flow divider is set to satisfy $2 \leqq L/D_2 \leqq 8$.

In the above described configuration, a flow divider can be obtained, where discrepancy (variation) in the flow rate ratio in the respective paths for the flow discharged from the outlet of the flow divider and entering the heat exchanger is small, and pressure loss is small when there is a change of approximately ±10° in the installation angles, a change in the dryness of the refrigerant at the inlet (0.2 to 0.4), or a change in the flow rate of the refrigerant (50% to 100%).

In the case of $L/D_2<2$, unevenness in the distribution of the liquid refrigerant in the circumferential direction due to a discrepancy in the installation angles or a bend in the inlet pipe 12 causes a discrepancy in the direction in which refrigerant Xin coming in through the inlet pipe 12 is ejected, and then a deviation in the distribution of the gas and liquid within the capillary holes, in other words, within the branching pipes 13, and thus, nonuniform flow is caused in the refrigerant. Meanwhile, in the case of $L/D_2>8$, the liquid refrigerant flows while making contact with the inner wall surface of the main body 11 of the flow divider, lowering the speed of the liquid refrigerant, and as a result, the refrigerant is subjected to the effects of gravity, so that the discrepancy in the installation angles makes the distribution of the gas and liquid in the circumferential direction uneven, and thus, nonuniform flow is caused in the refrigerant.

Figure 4:
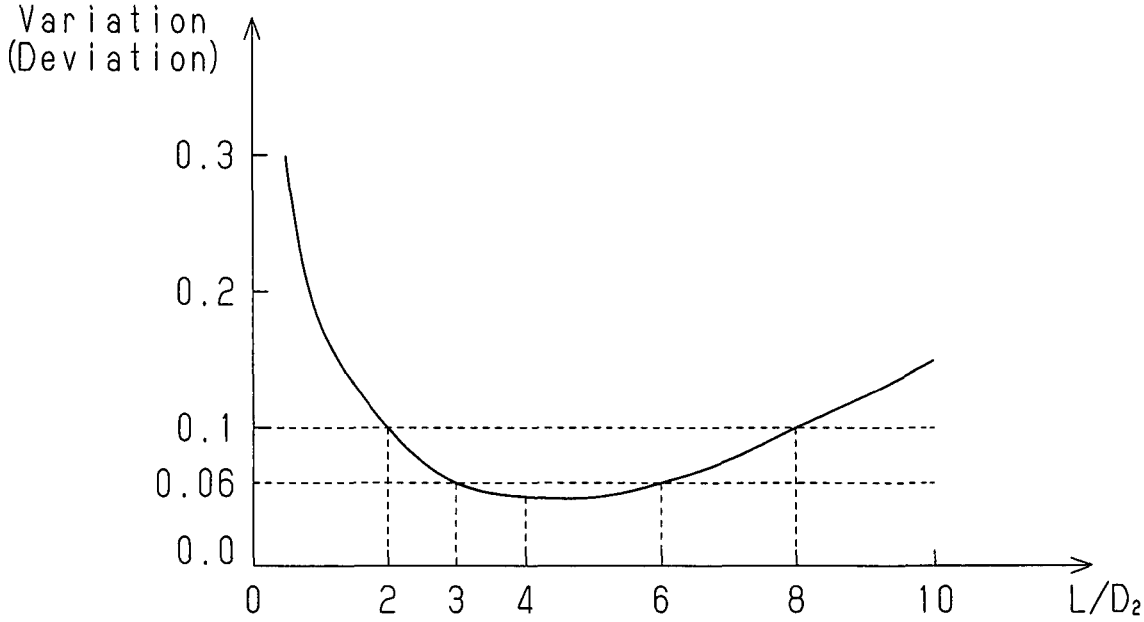
FIG. 4 is a graph showing the characteristics of the refrigerant flow divider of FIG. 2 in terms of change in the variation (deviation) in the flow rate ratio relative to $L/D_2$.

When the change in the variation (deviation) in the flow rate ratio relative to $L/D_2$ was checked, the results shown in FIG. 4 are gained.

Referring to FIG. 4, a range of $2 \leqq L/D_2 \leqq 8$ is appropriate for the variation (deviation) in the flow rate ratio to be no greater than 0.1. A range of $3 \leqq L/D_2 \leqq 6$ is more preferable for the variation (deviation) in the flow rate ratio to be no greater than 0.06, which is a stricter value.

Furthermore, in the above described configuration, in the case where the relationship $2 \leqq D_2^2/G \leqq 13$ holds between the flow rate G and the inner diameter D2 of the main body of the flow divider when the flow rate of the refrigerant Xin flowing in through the above described inlet pipe 12 is G kg/h, the ascent velocity of the refrigerant becomes optimal within the main body 11 of the flow divider, and thus, nonuniform flow if prevented without fail in the refrigerant. In the case of $D_2^2/G<2$, the ascent velocity of the refrigerant within the main body 11 of the flow divider increases, and when unevenness in the distribution of the liquid refrigerant in the circumferential direction due to discrepancy in the installation angles or a bend in the inlet pipe 12 causes a discrepancy in the direction in which the refrigerant coming in through the inlet pipe 12 is ejected, a deviation is caused in the distribution of the gas and liquid within the capillaries (in other words, within the branching pipes 13), and thus, nonuniform flow is caused in the refrigerant. Meanwhile, in the case of $D_2^2/G>13$, the ascent velocity of the refrigerant within the main body 11 of the flow divider becomes low and the refrigerant is subjected to the effects of gravity, and the amount of stagnant liquid in the lower portion increases. In other words, the interface between the gas and the liquid rises. As a result, the discrepancy in the installation angles, or the discrepancy in the margin for insertion of capillaries (in other words, the margin for insertion of branching pipes 13), makes the gas-liquid partition ratio of the refrigerant coming out through the branching pipes 13 different between respective paths. Thus, nonuniform flow is caused in the refrigerant.

Figure 5:
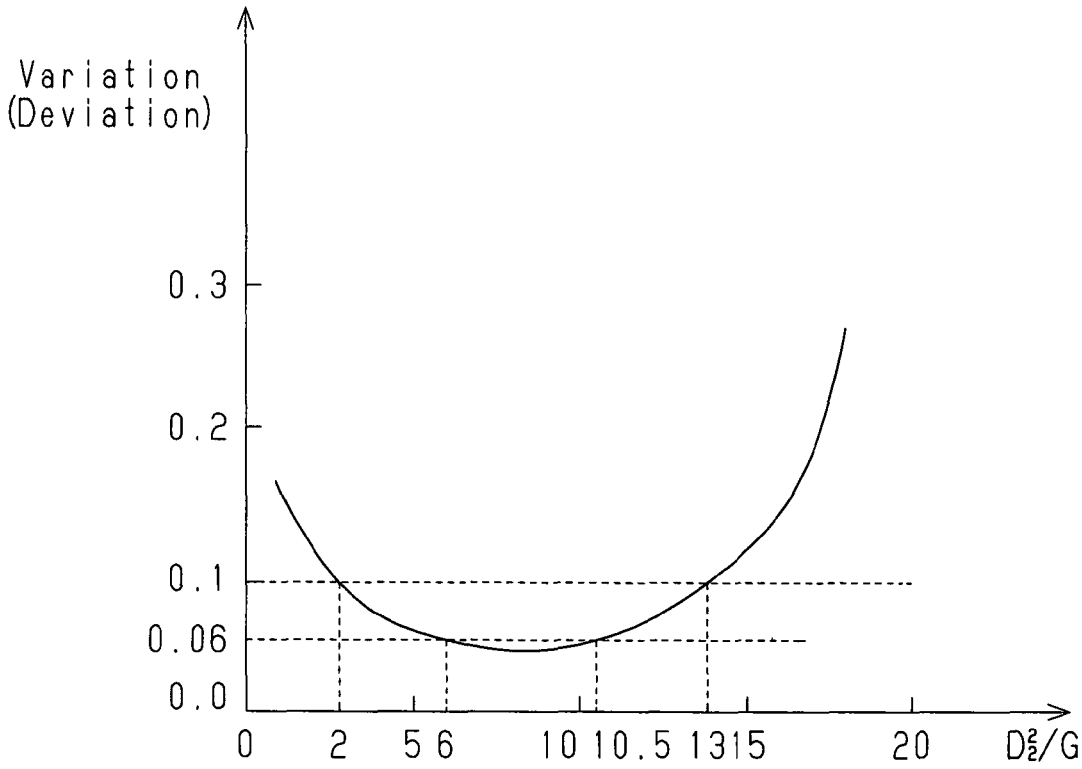
FIG. 5 is a graph showing the characteristics of the refrigerant flow divider of FIG. 2 in terms of change in the variation (deviation) in the flow rate ratio relative to $D_2^2/G$.

When the change in the variation (deviation) in the flow rate ratio relative to $D_2^2$ was checked, the results shown in FIG. 5 were gained.

Referring to FIG. 5, a range of $2 \leqq D_2^2/G \leqq 8$ is appropriate for the variation (deviation) in the flow rate ratio to be no greater than 0.1. A range of $6 \leqq D_2^2/G \leqq 10.5$ is more preferable for the variation (deviation) in the flow rate ratio to be no greater than 0.06, which is a stricter value.

In addition, when the performance class of the refrigeration unit in which a heat exchanger is mounted is C kW and the number of branches the refrigerant passes through within the refrigeration unit before flowing into the above described refrigerant flow divider is n, the flow rate of the refrigerant in each class is as shown in Table 1 (refrigerant: R410a), and therefore, the inner diameter $D_2$ of the cylindrical portion 11*c* of the main body of the flow divider satisfies the following formula which replaces the above described relationship $2 \leqq D_2^2/G \leqq 13$ for each class:

$$6.55(C/n)^{0.5} \leqq D_2 \leqq 9.64(C/n)^{0.5}$$

TABLE 1

| | 1 HP (refrigeration unit with 2.8 kW) | | 2 HP (refrigeration unit with 5.6 kW) | | 5 HP (refrigeration unit with 14 kW) | |
|---|---|---|---|---|---|---|
| | min | max | min | max | min | max |
| G [kg/h] | 20 | 60 | 40 | 120 | 100 | 300 |
| $D_2$ [mm] | 6.3-16.1 | 11.0-27.9 | 8.9-22.8 | 15.5-39.5 | 14.1-36.1 | 24.5-62.4 |
| | 11.0-16.1 | | 15.5-22.8 | | 24.5-36.1 | |

* in case of n = 1

The present invention is not limited to the above described embodiment, and the design can be appropriately modified within such a range that the gist of the present invention is not deviated from.

The invention claimed is:

1. A refrigerant flow divider, comprising:

an inlet pipe through which a refrigerant flows in, a main body of which the inside is a cavity, and a plurality of branching pipes through which a refrigerant flows out, wherein the main body is provided with a connection portion through which the inlet pipe is connected, an increasing diameter portion where the diameter gradually increases from the connection portion, a cylindrical portion having the same diameter as the maximum diameter of the increasing diameter portion, and a branching pipe connecting portion provided in a top portion of the cylindrical portion to which the branching pipes are connected at intervals of equal angles, where the length of the main body of the flow divider, defined as the distance between a border portion between the connection portion and the increasing diameter portion and a highest portion on the inner surface of the branch pipe connecting portion, is L mm and the inner diameter of the cylindrical portion of the main body is $D_2$ mm, the ratio of the length L to the inner diameter $D_2$ satisfies $2 \leqq L/D_2 \leqq 8$, and where the amount of the refrigerant flowing in through the inlet pipe is G kg/h, a relationship $2 \leqq D_2^2/G \leqq 13$ holds between the flow rate G and the inner diameter $D_2$ of the main body.

2. The refrigerant flow divider according to claim 1, wherein, where the performance class of a refrigeration unit in which a heat exchanger provided with the refrigerant flow divider is mounted is C kW and the number of branches through which the refrigerant passes within the refrigeration unit before flowing into the refrigerant flow divider is n, the inner diameter $D_2$ of the main body of the flow divider satisfies $6.55(C/n)^{0.5} \leqq D_2 \leqq 9.64(C/n)^{0.5}$.

* * * * *